US007052451B2

(12) United States Patent
Carr

(10) Patent No.: US 7,052,451 B2
(45) Date of Patent: May 30, 2006

(54) CONICAL PISTON SOLIDS DISCHARGE CENTRIFUGAL SEPARATOR

(75) Inventor: Robert B. Carr, Sharon, MA (US)

(73) Assignee: Wagner Development, Inc., Monaco (MC)

( * ) Notice: Subject to any disclaimer, the term of this patent is extended or adjusted under 35 U.S.C. 154(b) by 37 days.

(21) Appl. No.: 10/823,844

(22) Filed: Apr. 14, 2004

(65) Prior Publication Data

US 2005/0233882 A1 Oct. 20, 2005

(51) Int. Cl.
*B04B 11/05* (2006.01)
*B04B 11/08* (2006.01)

(52) U.S. Cl. ..... 494/50; 494/56; 494/65; 210/376

(58) Field of Classification Search ..... 494/46, 494/50–52, 55–59, 62, 65, 67, 83–84; 210/372–377
See application file for complete search history.

(56) References Cited

U.S. PATENT DOCUMENTS

| | | | |
|---|---|---|---|
| 1,909,188 | A | 5/1933 | Roberts |
| 2,094,058 | A | 9/1937 | Bryson |
| 3,306,681 | A | 2/1967 | Barringer |
| 3,403,848 | A | 10/1968 | Windsor et al. |
| 3,539,096 | A | 11/1970 | Lewis et al. |
| 3,741,465 | A | 6/1973 | Lincoln |
| 3,770,191 | A | 11/1973 | Blum |
| 4,155,503 | A | 5/1979 | Sears |
| 4,416,655 | A | 11/1983 | Bennett |
| 4,493,768 | A | 1/1985 | Kubr et al. |
| 4,493,769 | A | 1/1985 | Paschedag et al. |
| 4,692,247 | A | 9/1987 | Orlans |
| 5,250,180 | A | 10/1993 | Chang |
| 5,328,441 | A | 7/1994 | Carr |
| 5,356,367 | A | 10/1994 | Carr |
| 5,425,698 | A | 6/1995 | Carr |
| 5,454,777 | A | 10/1995 | Ziems et al. |
| 5,674,174 | A | 10/1997 | Carr |
| 5,733,238 | A | 3/1998 | Carr |
| 5,743,840 | A | 4/1998 | Carr |

(Continued)

FOREIGN PATENT DOCUMENTS

| | | |
|---|---|---|
| CH | 604 906 | 9/1978 |

(Continued)

OTHER PUBLICATIONS

Carr Powerfuge Brochure, Carr Separations, Inc., undated, p. 1-4.

(Continued)

*Primary Examiner*—Charles E. Cooley
(74) *Attorney, Agent, or Firm*—Weingarten, Schurgin, Gagnebin & Lebovici LLP

(57) ABSTRACT

A centrifugal separator includes a cylindrical bowl having a conical lower end with an opening through which feed liquid is injected during a feed mode of operation. The feed liquid is separated into centrate and solids, which accumulate along the inner surface of the bowl. A piston assembly includes a conical piston coupled to a piston actuator by a two-part piston shaft. During the feed mode of operation, the piston shaft is disconnected, the piston is held in an uppermost position by hydraulic pressure from the feed liquid, and a centrate valve on the piston is urged open to permit the centrate to flow out to a centrate discharge port. In a solids discharge mode of operation, the piston shaft is connected and the piston actuator urges the piston axially downward, closing the centrate valve and forcing the accumulated solids from the bowl via the opening in the conical lower end of the bowl.

13 Claims, 6 Drawing Sheets

U.S. PATENT DOCUMENTS

| | | | | |
|---|---|---|---|---|
| 5,879,279 | A | 3/1999 | Berger et al. | |
| 5,916,082 | A * | 6/1999 | Opfer | 494/26 |
| 6,126,587 | A | 10/2000 | Berger et al. | |
| 6,149,573 | A | 11/2000 | Berger et al. | |
| 6,224,532 | B1 | 5/2001 | Beattey | |
| 6,248,054 | B1 * | 6/2001 | Berger et al. | 494/55 |
| 6,251,056 | B1 * | 6/2001 | Berger et al. | 494/55 |
| 6,461,286 | B1 | 10/2002 | Beattey | |
| 6,478,724 | B1 | 11/2002 | Beattey | |
| 6,632,166 | B1 * | 10/2003 | Carr | 494/37 |
| 6,776,752 | B1 * | 8/2004 | Carr | 494/38 |
| 6,932,757 | B1 * | 8/2005 | Beattey | 494/55 |
| 2002/0016243 | A1 | 2/2002 | Carr | |
| 2003/0017931 | A1 * | 1/2003 | Beattey | 494/55 |
| 2003/0195105 | A1 * | 10/2003 | Carr | 494/38 |
| 2005/0003945 | A1 * | 1/2005 | Beattey | 494/55 |
| 2005/0009681 | A1 * | 1/2005 | Carr | 494/46 |
| 2005/0043164 | A1 * | 2/2005 | Opfer | 494/55 |
| 2005/0233882 | A1 * | 10/2005 | Carr | 494/50 |
| 2005/0233883 | A1 * | 10/2005 | Carr | 494/50 |

FOREIGN PATENT DOCUMENTS

| | | | |
|---|---|---|---|
| JP | 63-171656 | * | 7/1988 |
| JP | 7-144150 | * | 6/1995 |
| JP | 8-131894 | * | 5/1996 |
| JP | 8-266936 | * | 10/1996 |
| JP | 9-85129 | * | 3/1997 |
| JP | 9-262502 | * | 10/1997 |
| JP | 2000-140704 | * | 5/2000 |
| JP | 2003-144973 | * | 5/2002 |
| WO | WO 00/38762 | | 6/2000 |

OTHER PUBLICATIONS

Alfa-Laval CHPX Centrifuge Brochure, Alfa Laval, Inc., undated, p. 1.

Shanghai Centrifuge Institute, SCI Tube Bowl Centrifuge, Shanghai, China, undated, p. 1-2.

* cited by examiner

CONICAL PISTON SOLIDS DISCHARGE CENTRIFUGAL SEPARATOR

CROSS REFERENCE TO RELATED APPLICATIONS

None

STATEMENT REGARDING FEDERALLY SPONSORED RESEARCH OR DEVELOPMENT

Not Applicable

BACKGROUND OF THE INVENTION

The present invention generally relates to centrifuges and in particular to centrifuges enabling automatic discharge of solids that accumulate during separation.

Many different types of centrifugal separators are known for separating heterogeneous mixtures into components based on specific gravity. A heterogeneous mixture, which may also be referred to as feed material or feed liquid, is injected into a rotating bowl of the separator. The bowl rotates at high speeds and forces particles of the mixture, having a higher specific gravity, to separate from the liquid by sedimentation. As a result, a dense solids cake compresses tightly against the surface of the bowl, and the clarified liquid, or "centrate", forms radially inward from the solids cake. The bowl may rotate at speeds sufficient to produce forces 20,000 times greater than gravity to separate the solids from the centrate.

The solids accumulate along the wall of the bowl, and the centrate is drained off. Once it is determined that a desired amount of the solids has been accumulated, the separator is placed in a discharge mode in which the accumulated solids are removed from the separator. In a typical configuration, an internal scraper is engaged to scrape the solids from the walls of the separator bowl.

Prior separators have shortcomings when operating with particular kinds of materials. For example, many separators may not be capable of completely discharging residual solids that are sticky, which can result in poor yield. This can be especially problematic for high-value materials such as are encountered in pharmaceutical processes. Additionally, many separators subject the feed material to very high shear forces when accelerating the feed liquid to the rotational speed of the bowl, which can damage sensitive materials such as biological substances that include intact cells.

It would be desirable to have a centrifugal separator that can be effectively used with materials of the type described, namely those that result in sticky accumulated solids and those that are sensitive to shear forces generated during the centrifuge process.

BRIEF SUMMARY OF THE INVENTION

In accordance with the present invention, a centrifugal separator is disclosed that performs well with sticky solids and that exhibits low-shear acceleration of feed liquid, making the separator particularly useful for sensitive materials such as pharmaceutical and biological materials.

The separator includes a cylindrical bowl having a conical lower end with an opening through which feed liquid is injected during a feed mode of operation. As the bowl rotates at a high speed, the injected feed liquid encounters the sloped surface of the conical lower end of the bowl first. Rotational acceleration forces are imparted relatively gradually as the liquid continues its movement radially outward. The feed liquid is ultimately separated into centrate and solids, the solids accumulating along the inner surface of the bowl.

The separator further includes a piston assembly including a conical piston coupled to a piston actuator, with the piston being disposed within the bowl in tight-fitting relationship with the inner surface thereof. In a solids discharge mode of operation, the piston actuator urges the piston axially downward to force the accumulated solids from the bowl via the opening in the conical lower end of the bowl. The conical shape promotes relatively complete discharge of the solids.

In the disclosed separator, the piston is held in an uppermost position during the feed mode of operation by hydraulic pressure from the feed liquid. The piston includes a centrate valve that is urged open during the feed mode of operation to permit the centrate to flow out of the bowl and into a passage leading to a centrate discharge port. As the piston is urged downward during the solids discharge mode of operation, the centrate valve automatically closes, preventing the accumulated solids from passing into the centrate passage.

The disclosed separator also includes a two-part piston shaft having a connected position and a disconnected position. When the piston shaft is in the disconnected position, the piston is permitted to be forced upwardly and to rotate with the bowl. When the piston shaft is in the connected position, the piston can be pushed and pulled axially by the piston actuator, thus facilitating the solids discharge mode of operation.

Other aspects, features, and advantages of the present invention will be apparent from the Detailed Description that follows.

DETAILED DESCRIPTION OF THE INVENTION

Figure 1:
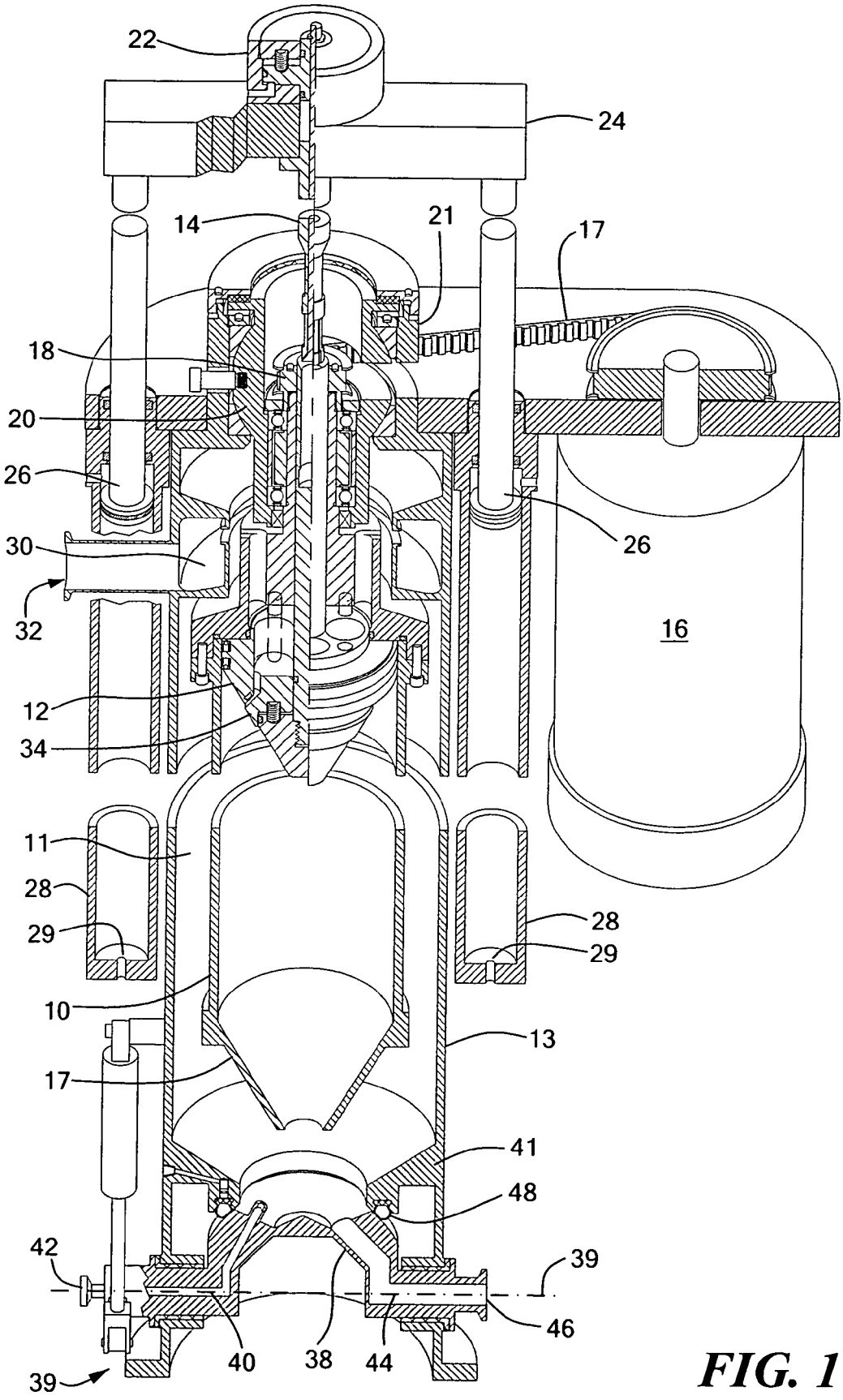
FIG. 1 is a section view of a conical piston solids discharge centrifuge in accordance with the present invention.

FIG. 1 shows a centrifugal separator in vertical section, with a middle portion removed so as to illustrate a horizontal section as well. The centrifugal separator includes a cylindrical separator bowl 10 mounted in a central region 11 of a separator housing 13. The separator bowl 10 is preferably a cylindrical type bowl having a relatively small diameter D and a length L such that the ratio of L/D is approximately 5/1 or greater. The separator includes a piston assembly consisting of a piston 12 connected to a piston shaft 14. As shown, the piston 12 has a conical shape that matches the shape of a conical feed cone 17 of the bowl 10. The feed cone 17 acts as a rotational accelerator of the feed liquid during a feed mode of operation of the separator.

A variable speed drive motor 16 is connected by a drive belt 17 to a drive pulley 18 of a spherically mounted bearing and spindle assembly 20 located at a collar-like extension 21 of the upper end of the separator housing 13. The drive motor 16 is controllably operated to rotate the separator bowl 10 at desired speeds for separating the feed liquid.

A piston shaft coupling cylinder 22 is mounted in a crosshead 24 of a piston actuator which includes two piston actuator plungers 26 mounted in respective piston actuator cylinders 28. Each piston actuator plunger 26 is operatively connected to the piston shaft 14 via the crosshead 24 for raising and lowering the piston 12 within the separator bowl 10 in response to compressed air or hydraulic fluid introduced at piston actuator ports 29. As described in greater detail below, the piston shaft 14 includes two parts that are selectively connected together or disconnected depending on the operating mode, such that the piston 12 is permitted to rotate with the bowl 10 when the parts are disconnected, and can be moved axially within the bowl 10 when the parts are connected.

Also shown in FIG. 1 are a centrate case 30, a centrate outlet port 32 and a centrate valve 34, all of which are involved in removing the centrate, or clarified liquid, from the centrifugal separator during operation, as described in more detail below. A solids valve 38 is mounted in a lower end region 39 of the separator housing 13, below an inward-facing flange 41. The solids valve 38 incorporates both a feed liquid passage 40 in communication with a feed liquid port 42, as well as a residual liquid drain passage 44 in communication with a residual liquid drain port 46. A solids valve seal 48 is disposed on a lower surface of the flange 41. The solids valve 38 is shown in a closed position maintained during the feed mode of operation of the separator. The solids valve 38 can be rotated along axis 49 to an open position such that accumulated solids can be discharged through the lower end of the separator during the solids discharge mode of operation.

Figure 2:
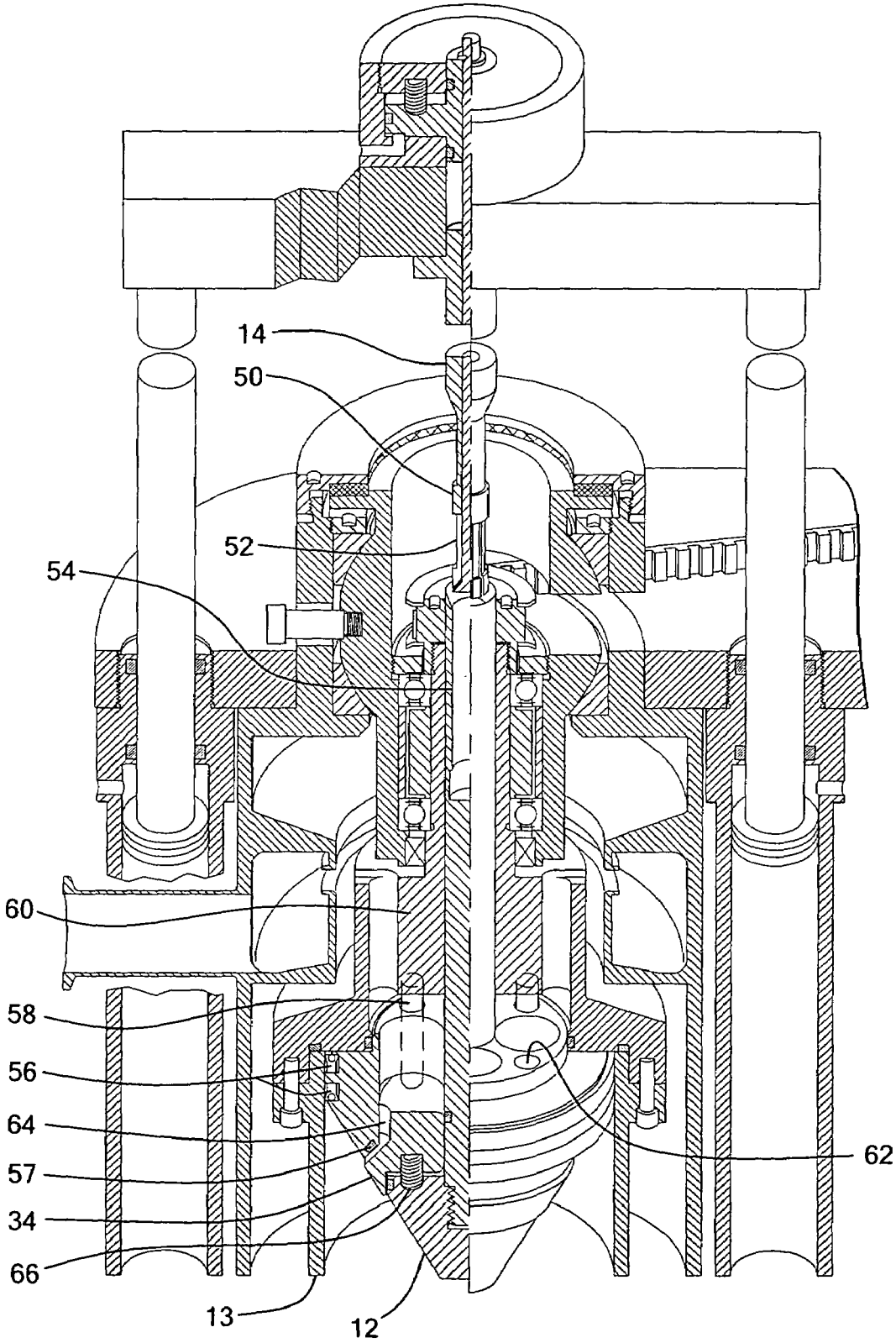
FIG. 2 is a detailed section view of an upper portion of the centrifuge of FIG. 1.

FIG. 2 shows the upper portion of the separator in greater detail. The two-part piston shaft 14 includes an upper piston shaft 50 with a coupling portion 52, and a lower piston shaft 54. The manner in which the upper and lower piston shafts 50 and 54 engage each other is described below. FIG. 2 also shows piston seals 56 that seal the interface between the piston 12 and the inner surface of the bowl 13. The seals 56 are of the type commonly referred to as O-ring loaded lip seals, and are made of a TEFLON-containing (E. I. du Pont de Nemours and Company, 1007 Market Street, Wilmington, Del. 19898) elastomeric material. Centrate seals 57 of similar construction seal the interface between the centrate valve 34 and the upper part of the piston 12 when the centrate valve 34 is closed.

In FIG. 2, the centrate valve 34 is shown in the open position, which results from the downward pushing action of pins 58 extending from a hub 60 through openings 62 in the upper part of the piston 12. With the centrate valve 34 in this open position, centrate can flow through small grooves 64. The centrate valve 34 is open only when the piston 12 is at its uppermost position against the hub 60. As the piston is pushed downward away from the pins 58 by the piston actuator, springs 66 urge the centrate valve slightly upward to a closed position, which is maintained throughout the solids discharge process.

Figure 3:
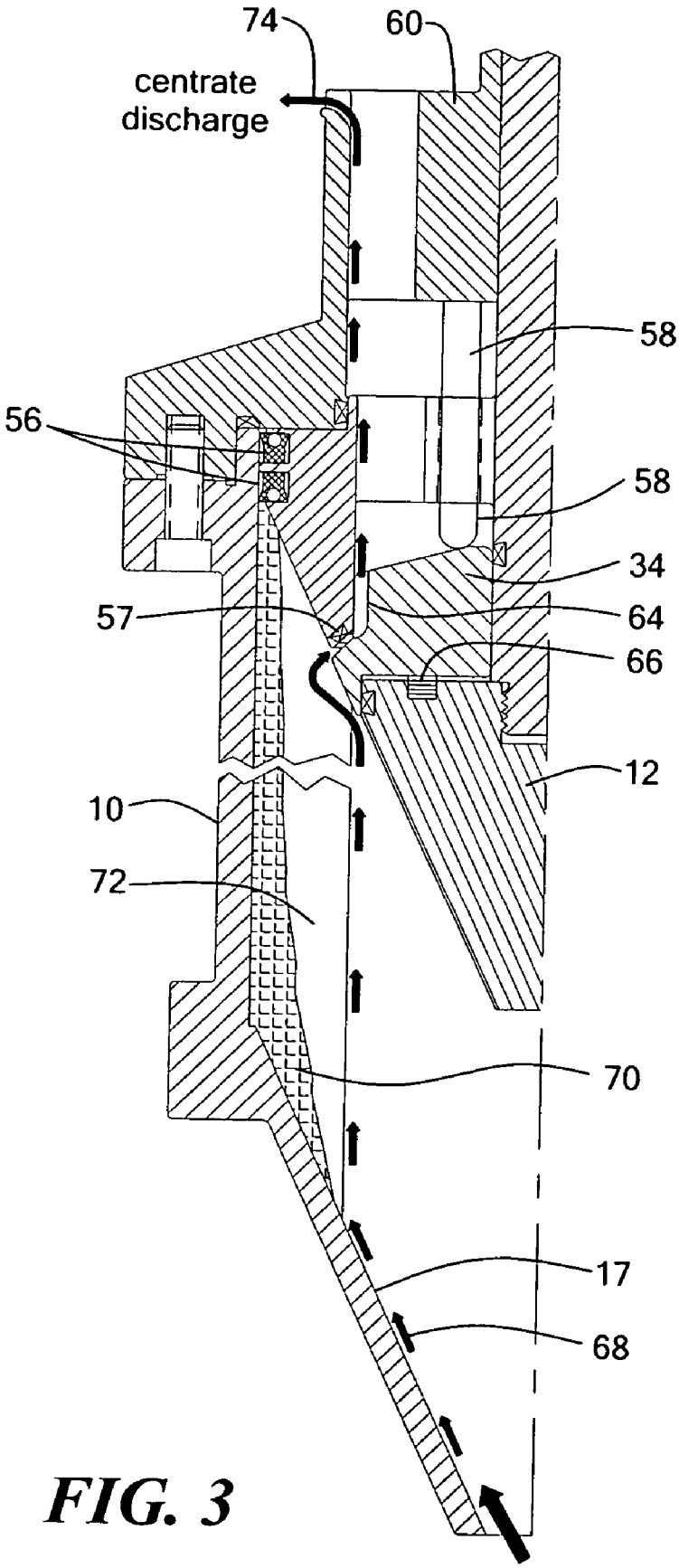
FIG. 3 is a partial section view of the centrifuge of FIG. 1 illustrating operation in feed mode.

FIG. 3 illustrates operation of the separator during a feed mode of operation, during which the bowl 10 and piston 12 are rotating at high speed. Solids-bearing feed liquid flows in a path 68 up the inner surface of the conical feed cone 17. Under the separation forces generated by high-speed rotation of the bowl 10, the feed liquid is separated into accumulated solids 70 and a relatively solids-free centrate 72. Hydraulic pressure from the centrate 72 holds the piston 12 upward against the hub 60 of the bowl, maintaining the centrate valve 34 in the open position. At the inner surface of the centrate 72, it flows through the grooves 64 of the centrate valve 34 and continues upward along a discharge path until exiting the bowl at a centrate discharge opening 74.

Figure 4:
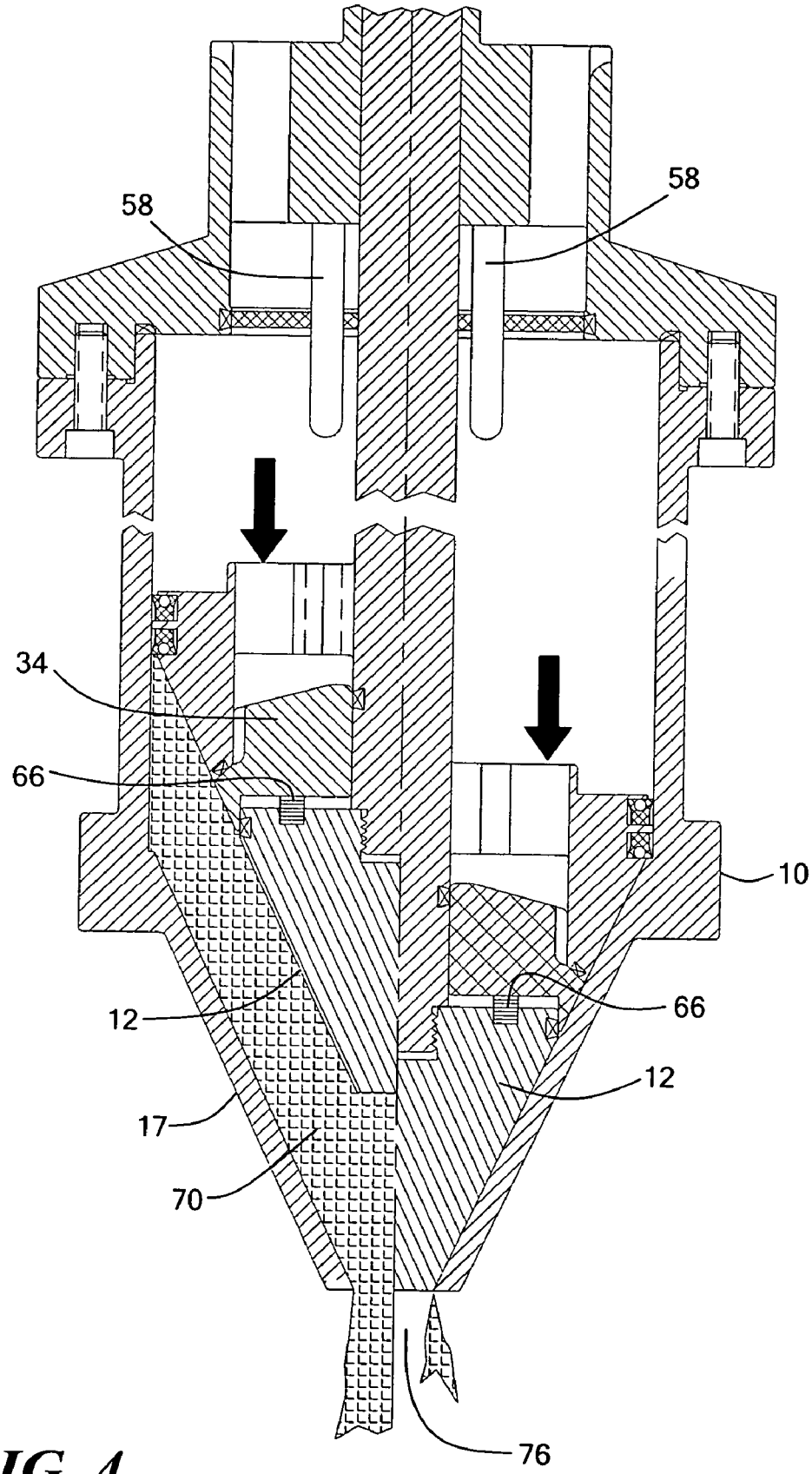
FIG. 4 is a section view of the centrifuge of FIG. 1 illustrating operation in solids discharge mode.

FIG. 4 illustrates operation of the separator during a solids discharge mode of operation. FIG. 4 is split lengthwise to show two separate positions of the piston 12. On the left, the piston 12 is partway through its downward travel, and on the right, the piston 12 is at its lowermost point at the completion of the discharge operation, with its conical outer surface resting against the inner surface of the conical feed cone 17. It will be observed that the centrate valve 34 is closed, under the upward urging force of the springs 66. As the piston 12 travels downward, the accumulated solids 70 are pressed out of an opening 76 at the bottom of the bowl 10. The conical outer surface of the piston 12 and the inner surface of the conical feed cone 17 are machined for a precise fit, so that the squeezing action of these two surfaces can efficiently remove as much of the solids 70 as possible. Any solids remaining after the discharge process are removed by clean-in-place processes after the piston 12 is returned to its uppermost position by the piston actuator.

Figure 5:
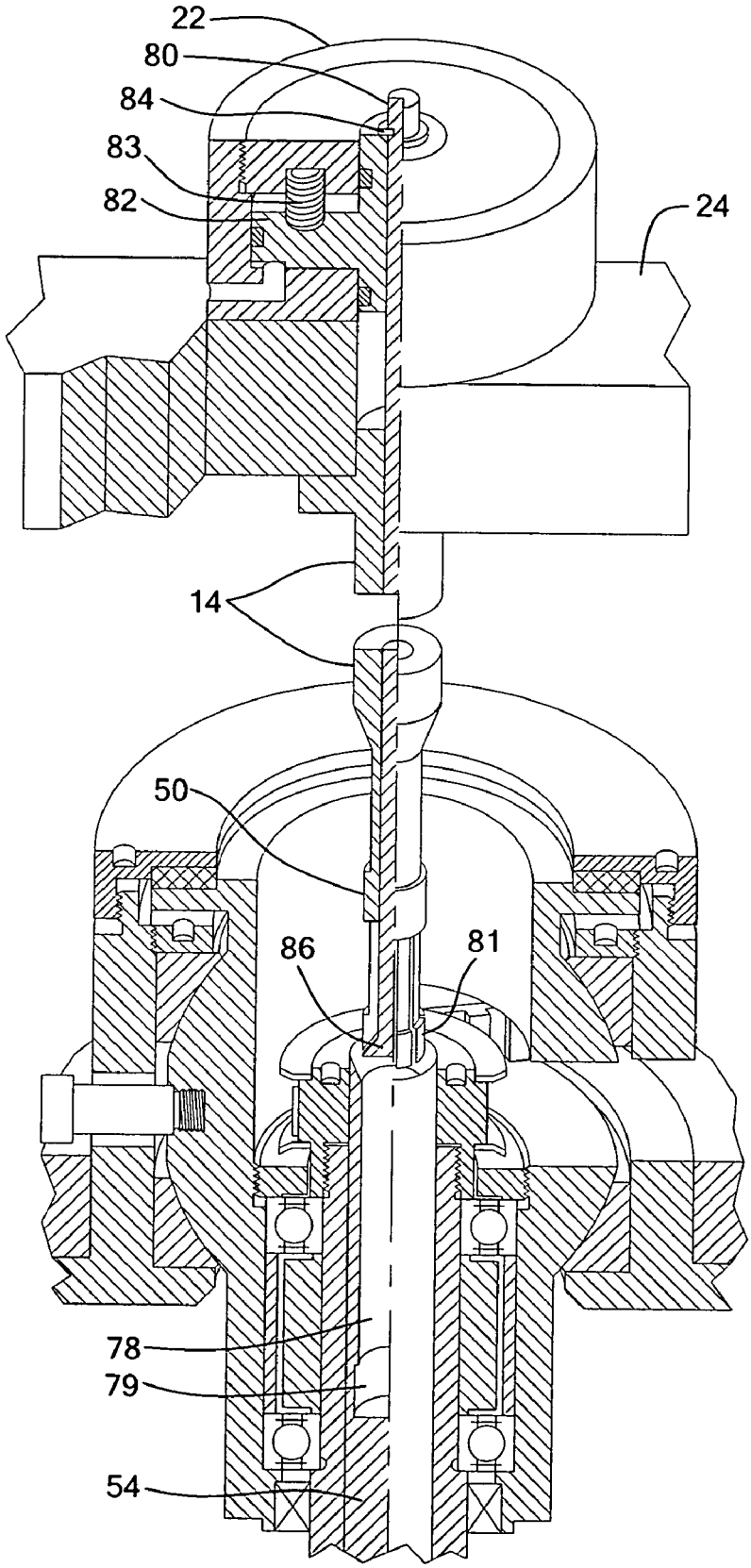
FIG. 5 is a detailed section view of the upper part of the centrifuge of FIG. 1 when a piston shaft is disconnected to permit rotation of the bowl.
Figure 6:
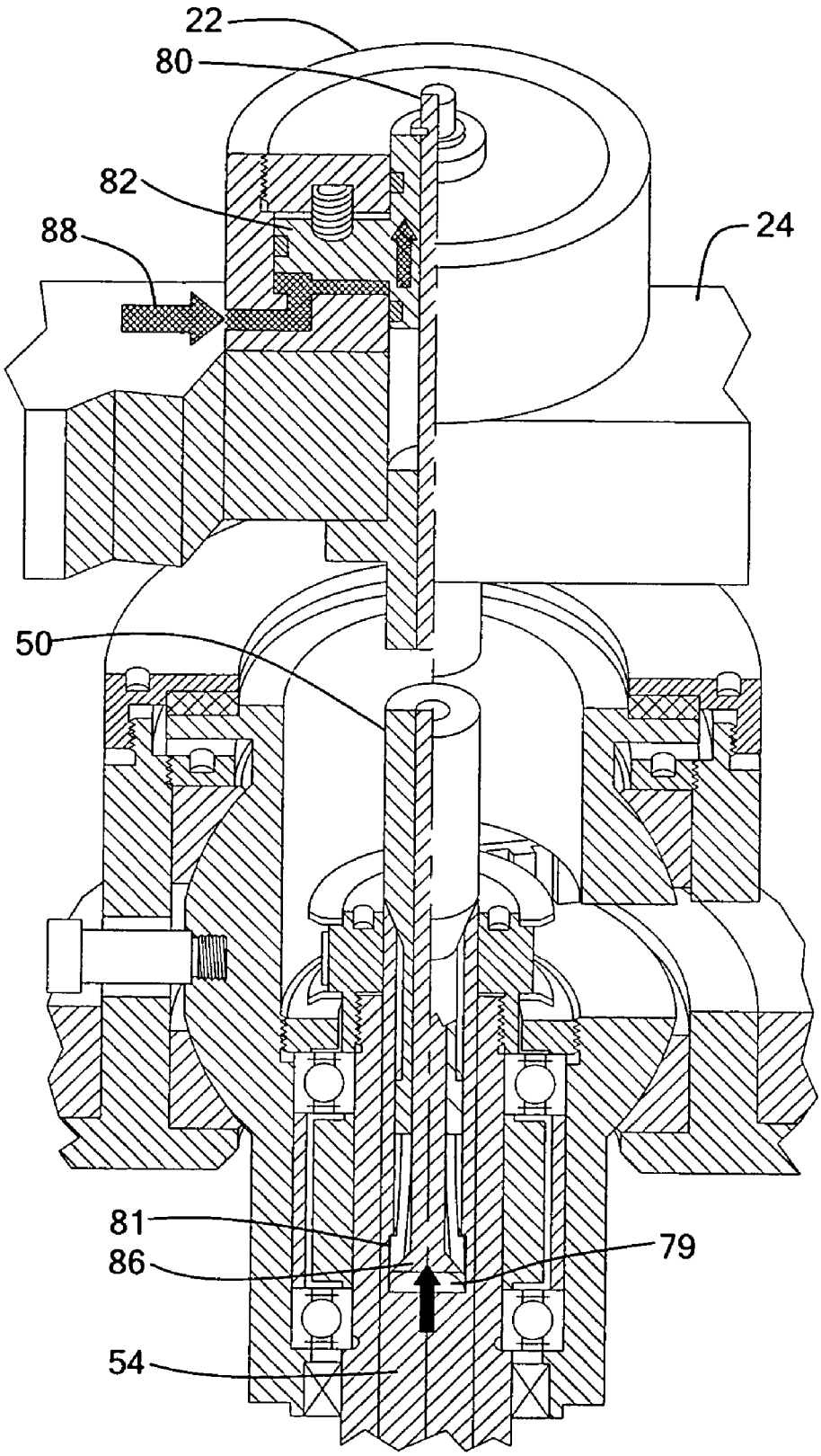
FIG. 6 is a detailed section view of the upper part of the centrifuge of FIG. 1 when the piston shaft is connected to move a piston axially within the bowl.

FIGS. 5 and 6 illustrate the configuration and operation of the mechanical coupling between the piston 12 and the crosshead 24. The upper piston shaft 50 extends from the underside of the crosshead 24 and moves with it in response to actuation by the piston actuators. FIG. 5 shows the upper piston shaft in a disconnected position in which it is withdrawn from an upper hollow portion 78 of the lower piston shaft 54. It will be observed that the hollow portion 78 includes a slightly wider chamber 79 whose use is explained below. The upper piston shaft 50 is hollow along its entire length, and a coupling lock draw bar 80 is disposed therein. At its lower end, the upper piston shaft 50 includes a plurality of flexible fingers 81 whose function is explained below.

At the upper end, the coupling lock draw bar 80 is mechanically connected to a coupling lock piston 82 located within the coupling lock cylinder 22, such as by a horizontal pin 84 as shown. The coupling lock piston 82 is biased to a downward position by a spring 83. At its lower end 86, the coupling lock draw bar 80 has a flared shape for use in locking the upper and lower piston shafts 50, 54 together as described below.

When the piston shaft is in the disconnected position shown in FIG. 5, the piston 12 is free to move in response to forces other than those generated by the piston actuator. In particular, the piston 12 is held upwardly by hydraulic forces and rotates with the bowl 10 during the feed mode of operation, as described above. It should be noted that at the very beginning of the feed mode of operation, before sufficient hydraulic pressure is present, the piston is held at substantially its uppermost position by frictional forces between the seals 56 and the inner wall of the bowl 10 (FIG. 3). As hydraulic pressure builds, the piston is then pushed upward firmly enough to open the centrate valve 34.

FIG. 6 shows the upper piston shaft in a connected position in which it is inserted into the upper hollow portion 78 (FIG. 5) of the lower piston shaft 54. The insertion typically occurs just prior to the solids discharge operating mode, when the piston 12 is located at its uppermost position within the bowl 10, as the piston actuator lowers the upper piston shaft 50 into the lower piston shaft 54. Then, hydraulic or pneumatic pressure 88 is provided to urge the coupling lock piston 82 upwardly, which in turn urges the coupling lock draw bar 80 upwardly with respect to the upper piston shaft 50. The flanged lower portion 86 of the coupling lock draw bar 80 pushes against the fingers 81 and urges them against the walls of the chamber 79, locking the upper and lower piston shafts 50, 54 together. In this connected configuration, the axial forces generated by the piston actuator cause the piston 12 to move axially. The connected configuration is maintained throughout the solids discharge mode of operation in which the piston 12 is moved downwardly to discharge the accumulated solids. The piston 12 is drawn to its uppermost position when the discharging of solids is complete, and the upper piston shaft 50 is then disconnected from the lower piston shaft 54 in preparation for the next cycle of feed mode operation. As mentioned above, the piston 12 remains in this position due to the frictional forces between the seals 56 and the inner wall of the bowl 10 (FIG. 3).

It will be apparent to those skilled in the art that modifications to and variations of the disclosed methods and apparatus are possible without departing from the inventive concepts disclosed herein, and therefore the invention should not be viewed as limited except to the full scope and spirit of the appended claims.

What is claimed is:

1. A centrifugal separator, comprising:

a cylindrical bowl having a conical lower end with an opening through which feed liquid is injected during a feed mode of operation, the bowl being operative during the feed mode of operation to rotate at a high speed to separate the feed liquid into centrate and solids, the solids accumulating along the inner surface of the bowl; and a piston assembly including a conical piston coupled to a piston actuator, the piston being disposed within the bowl in tight-fitting relationship with the inner surface thereof, the piston actuator being operative in a solids discharge mode of operation to urge the piston axially downward in the bowl to force the accumulated solids from the bowl via the opening in the conical lower end of the bowl.

2. A centrifugal separator according to claim 1, wherein the piston includes a centrate valve having an open position in the feed mode of operation and a closed position in the solids discharge mode of operation, the centrate valve being operative in the open position to permit the flow of the centrate from the bowl into a passage to a centrate discharge port of the separator, the centrate valve being operative in the closed position to block the passage of the accumulated solids from the bowl into the passage to the centrate discharge port.

3. A centrifugal separator according to claim 2, wherein the centrate valve is an annular member located at substantially the midsection of the piston.

4. A centrifugal separator according to claim 2, wherein the piston is configured to bias the centrate valve in the closed position, the bowl includes a hub against which the piston is located during the feed mode of operation, and the hub and the piston are cooperatively configured such that the centrate valve is urged to the open position when the piston is located against the hub.

5. A centrifugal separator according to claim 4, wherein the piston includes one or more springs operative to bias the centrate valve in the closed position.

6. A centrifugal separator according to claim 4, wherein the hub includes one or more downward-extending pins, and the piston includes one or more openings through which the pins extend to the pins contact the centrate valve and maintain it in the open position when the piston is located against the hub.

7. A centrifugal separator according to claim 1, wherein the coupling between the piston and the piston actuator is operative to permit the piston to be held at an uppermost position in the bowl by hydraulic pressure from the feed liquid in the feed mode of operation.

8. A centrifugal separator according to claim 1, wherein the coupling between the piston and the piston actuator comprises:

a lower piston shaft extending upwardly from the piston and having a hollow upper portion;

a hollow upper piston shaft having first and second positions with respect to the lower piston shaft, the first position being a disconnected position in which the upper piston shaft is withdrawn from the hollow portion of the lower piston shaft, the second position being a connected position in which the upper piston shaft is inserted within the hollow portion of the lower piston shaft and mechanically linked thereto, the upper piston shaft including a plurality of flexible, downward-extending fingers that in a relaxed position permit the upper piston shaft to slide with respect to the lower piston shaft;

a coupling lock draw bar disposed within the upper piston shaft, the coupling lock draw bar being configured at a lower end thereof to urge the fingers of the upper piston shaft outwardly against the internal wall of the lower piston shaft to lock the upper and lower piston shafts together when the coupling lock draw bar is urged upwardly with respect to the upper piston shaft; and a mechanism at the upper end of the upper piston shaft operative to selectively apply an upward force on the coupling lock draw bar with respect to the upper piston shaft to mechanically link the upper and lower piston shafts together.

9. A centrifugal separator according to claim 8, wherein the force-applying mechanism comprises a coupling lock cylinder through which the coupling lock draw bar extends, the coupling lock cylinder including an actuatable piston operative in response to an actuating force to apply the upward force to the coupling lock draw bar.

10. A centrifugal separator according to claim 9, wherein the actuating force is hydraulic.

11. A centrifugal separator according to claim 9, wherein the actuating force is pneumatic.

12. A centrifugal separator, comprising:

a cylindrical bowl having a conical lower end with an opening through which feed liquid is injected during a feed mode of operation, the bowl being operative during the feed mode of operation to rotate at a high speed to separate the feed liquid into centrate and solids, the solids accumulating along the inner surface of the bowl; and a piston assembly including a conical piston coupled to a piston actuator, the piston being disposed within the bowl in tight-fitting relationship with the inner surface thereof, the piston actuator being operative in a solids discharge mode of operation to urge the piston axially downward in the bowl to force the accumulated solids from the bowl via the opening in the conical lower end of the bowl, wherein the piston includes a centrate valve having an open position in the feed mode of operation and a closed position in the solids discharge mode of operation, the centrate valve being operative in the open position to permit the flow of the centrate from the bowl into a passage to a centrate discharge port of the separator, the centrate valve being operative in the closed position to block the passage of the accumulated solids from the bowl into the passage to the centrate discharge port.

13. A centrifugal separator, comprising:

a cylindrical bowl having a conical lower end with an opening through which feed liquid is injected during a feed mode of operation, the bowl being operative during the feed mode of operation to rotate at a high speed to separate the feed liquid into centrate and solids, the solids accumulating along the inner surface of the bowl; and a piston assembly including a conical piston coupled to a piston actuator, the piston being disposed within the bowl in tight-fitting relationship with the inner surface thereof, the piston actuator being operative in a solids discharge mode of operation to urge the piston axially downward in the bowl to force the accumulated solids from the bowl via the opening in the conical lower end of the bowl, wherein the coupling between the piston and the piston actuator comprises a lower piston shaft extending upwardly from the piston and having a hollow upper portion, a hollow upper piston shaft having first and second positions with respect to the lower piston shaft, the first position being a disconnected position in which the upper piston shaft is withdrawn from the hollow portion of the lower piston shaft, the second position being a connected position in which the upper piston shaft is inserted within the hollow portion of the lower piston shaft and mechanically linked thereto, the upper piston shaft including a plurality of flexible, downward-extending fingers that in a relaxed position permit the upper piston shaft to slide with respect to the lower piston shaft, a coupling lock draw bar disposed within the upper piston shaft, the coupling lock draw bar being configured at a lower end thereof to urge the fingers of the upper piston shaft outwardly against the internal wall of the lower piston shaft to lock the upper and lower piston shafts together when the coupling lock draw bar is urged upwardly with respect to the upper piston shaft, and a mechanism at the upper end of the upper piston shaft operative to selectively apply an upward force on the coupling lock draw bar with respect to the upper piston shaft to mechanically link the upper and lower piston shafts together.

* * * * *